United States Patent [19]

Hall

[11] 4,023,353

[45] May 17, 1977

[54] MULTI-FLOW MARINE JET-PROPULSION APPARATUS

[76] Inventor: Kimball P. Hall, 716 Kingston Road, Princeton, N.J. 08540

[22] Filed: Dec. 3, 1975

[21] Appl. No.: 637,398

[52] U.S. Cl. ..... 60/221; 115/17; 115/34 A; 415/131; 416/93 A; 115/16

[51] Int. Cl.[2] ..... B63H 1/28

[58] Field of Search ..... 60/221, 226 A, 224, 60/229, 230; 416/93 M, 93 A; 415/131; 115/34 A, 34 R, 17, 11, 14, 16

[56] References Cited

UNITED STATES PATENTS

| | | | |
|---|---|---|---|
| 3,467,051 | 9/1969 | Shimanckas | 416/93 M |
| 3,556,041 | 1/1971 | Shimanckas | 416/93 M |
| 3,871,324 | 3/1975 | Snyder | 115/17 |

*Primary Examiner*—William L. Freeh
*Assistant Examiner*—Robert E. Garrett
*Attorney, Agent, or Firm*—Emile Paul

[57] ABSTRACT

An outboard marine propulsion apparatus has a rotor unit axially displaceable between forward and reverse operating positions. In the forward position, concentric horizontal paths through the apparatus are provided for rearward discharge of the propulsive water stream and the engine exhaust gases; in the reverse position, paths are provided for discharging the propulsive water stream forwardly and the exhaust gases in radially outward directions ahead of the rotor unit. For reverse operation one of the concentric flow paths is closed by an automatically actuated butterfly valve responsive to the axial displacement of the rotor unit. A dashpot device controls the axial sliding speed of the rotor unit.

10 Claims, 3 Drawing Figures

MULTI-FLOW MARINE JET-PROPULSION APPARATUS

My invention is concerned with the type of outboard propulsion system wherein the bladed rotor unit or propeller is axially displaceable between forward and reverse drive positions, and wherein the engine exhaust gases are discharged under water rearwardly through the rotor hub during forward drive, and radially outwardly at a discharge location forward of the propeller during reverse drive. An important advantage of such an arrangement, examples of which are disclosed in U.S. Pat. Nos. 3,467,051 and 3,871,324, is that it inhibits the presence of gas bubbles in the vicinity of the working surface of the rotor blades during reverse drive, thereby avoiding the cavitation, erosion, reduced efficiency, and reduction in thrust that would otherwise occur.

It is my purpose to utilize this type of engine exhaust gas control in conjunction with a jet-pump propulsion system, incorporating therein new features which have been found to produce a propulsion system capable of smoother and more efficient operation.

It is an object of the invention to provide, in a marine propulsion apparatus having a stator and a horizontally displaceable rotor, a variable-volume dashpot chamber formed by interengaging portions of the rear end of the rotor and the front of the stator.

It is another object to provide a central passageway through the rotor and stator wherein flow is controlled by a butterfly valve disposed in said passageway and actuated by means responsive to axial displacements of the rotor.

These and other objects of the invention will become apparent in the light of the detailed description which follows in conjunction with the accompanying drawings, wherein.

Figure 1:
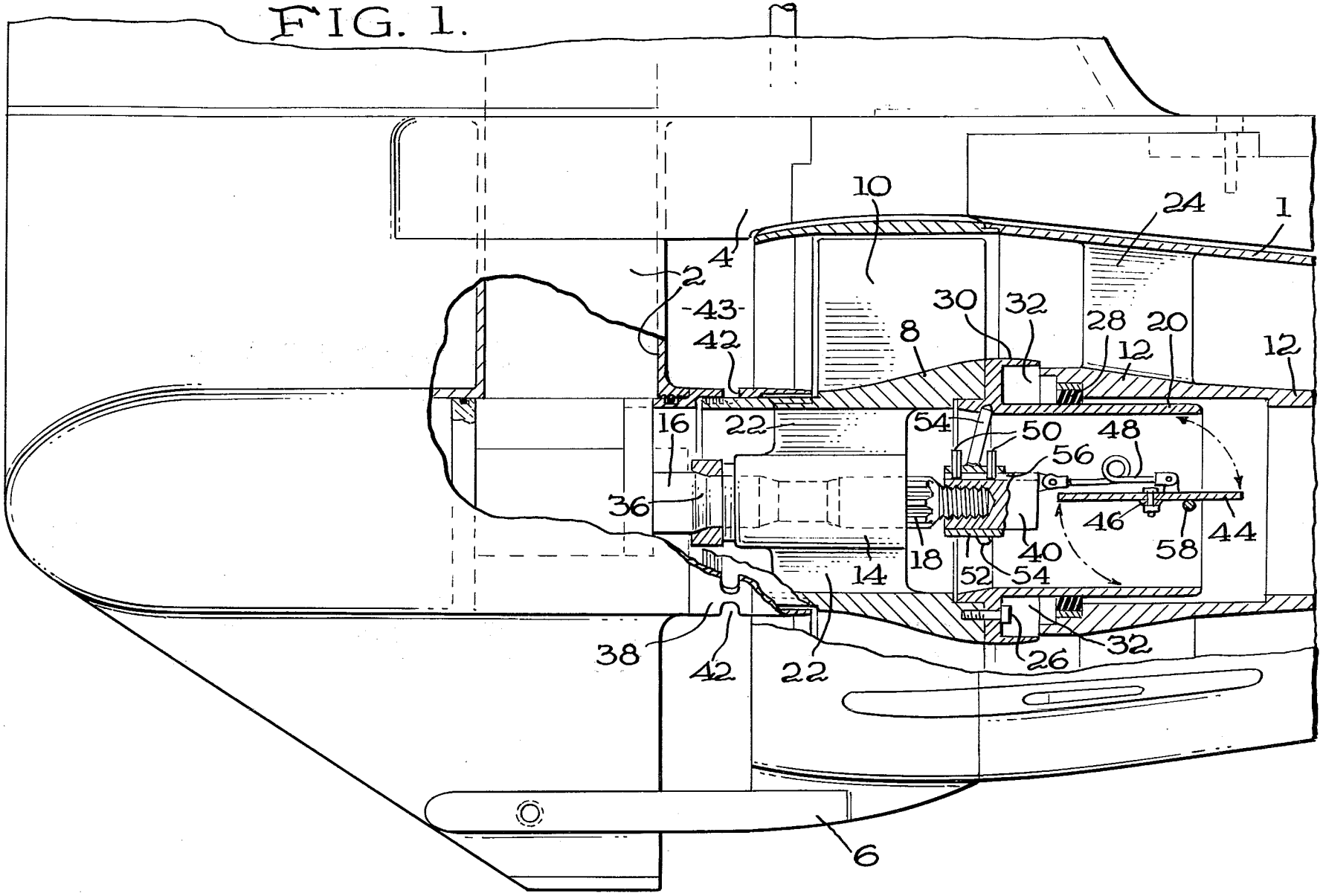
FIG. 1 is a vertical longitudinal section showing the parts in position for forward propulsion.

Throughout this specification the terms —front— and —forward— denote the direction from transom to bow of the watercraft to which the propulsion apparatus will be attached in practice, and the terms —rear— and —rearward— will denote the reverse direction.

The drawings illustrate an embodiment of the invention in the form of a shrouded jet-pump attached to and supported by a transmission housing 2 which forms a part of the lower unit of a conventional outboard engine. As in my former U.S. Pat. Nos. 3,389,558 and 3,849,982, the shroud 1 is composed of separable, releasably connected front and rear sections, and connected at its forward end to the housing 2 by upper bracket means 4 and lower bracket means 6. A rotor having an outer hub 8 and blades 10 is positioned in the front shroud section, and a stator tube 12 supported in fixed relation to the rear shroud section by struts or guide vanes 24.

An inner hub 14 is fixed within the outer hub 8 by struts 22 to provide an annular passageway between the hubs. The inner hub is formed with a through bore aligned with the shroud axis and engaging drive shaft 16 which extends rearwardly from housing 2. Splines 18 on the drive shaft engage complementary splines formed on the bore surface of inner tube 14, whereby the rotor is supported by the drive shaft in driven relation thereto while being axially displaceable relative to the shaft. Attached to outer hub 8 for rotation therewith are front and rear tubular extensions 34 and 20, the latter being releasably secured to the hub by bolts 26. (The assembly of parts 8, 20, and 34 will be referred to hereinafter as the —rotor tube—.)

Stator tube 12 is provided with a rubber bearing 28 engaging the outside of rotor extension 20 while permitting rotary and axial displacements of the rotor. An external circular flange 30 of L-shaped cross-section, in conjunction with the exterior of extension 20, forms a rearwardly facing annular recess 32 which receives the front end of stator tube 12. The variable-volume chamber 32 formed by the adjacent co-acting portions of the fixed and movable tubes functions as a dashpot or shock absorber during axial displacement of the rotor.

During forward drive the engine exhaust gases pass from housing 2 discharging rearwardly through the central passageway formed by the rotor and stator tubes. At the same time a propulsive water stream is driven rearwardly by the rotor blades through the annular passageway bounded by shroud 1. The mixed flow of water and exhaust gases through the central passageway, induced by the pumping action of the shrouded rotor blades, assures the discharge of the exhaust gases to a point substantially downstream of the rotor blades.

The reactive force associated with the forward drive operation acts on the rotor blades to maintain the front end of the rotor in contact with stop 36 as shown in FIG. 1. In this position the front end of the rotor tube is telescopically nested in ring 38 to provide a direct, substantially fluid-tight connection between housing 2 and the central passageway through the propulsion unit. On shifting to reverse drive (by means of conventional reversing mechanism, not shown), the reactive force will displace the rotor rearwardly against stop nut 40 mounted on the rear of drive shaft 16, shown in FIG. 2. It will be noted that ring 38 is equipped with apertures 42 which are closed by the front of the rotor tube in the forward position. When the rotor is displaced to the reverse position of FIG. 2, the apertures are uncovered, thereby permitting discharge of the exhaust gases radially outward into the space 43 which separates housing 2 from the jet-pump shroud.

It is known that the propulsive thrust in reverse drive of this type of apparatus can be significantly improved by shutting off the central passageway to fluid flow. There will now be described my new and improved mechanism for effecting this function.

Figures 2, 3:
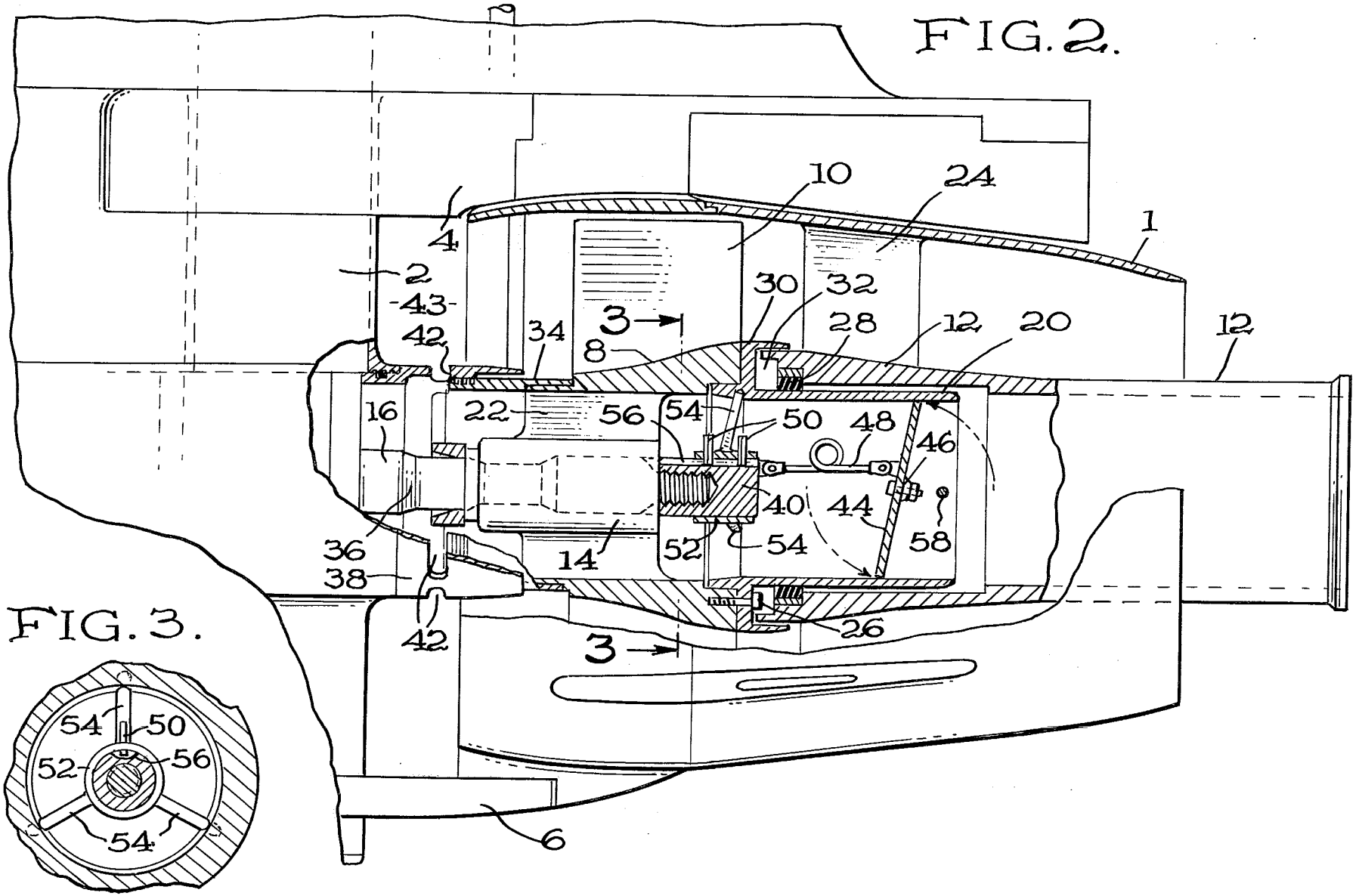
FIG. 2 is a similar view showing the parts in position for reverse propulsion.
FIG. 3 is a detail sectional view taken along line 3—3 of FIG. 2.

Butterfly valve 44 is mounted on pivot rod 46 for rotation from the open position shown in FIG. 1 to the closed position shown in FIG. 2, the axis of rotation being fixed with respect to the rotor. The valve is actuated by spring link 48 which connects the valve to stop nut 40 on the rear end of drive shaft 16. Inadvertent unscrewing of nut 40 from the drive shaft is prevented by detents 50 carried by collar 52, the latter being in slidable engagement with nut 40 and secured to the rotor tube by strut members 54. The detents engage slot 56 formed in nut 40 while permitting relative axial displacement between nut and collar. A stop rod 58 fixed to the rotor tube establishes optimum open position of the valve for forward drive. Parts 50–56 are shown in detail in FIG. 3.

In shifting between forward and reverse drive operations, the rotor tube and attached pivot rod 46 and collar 52 move between the forward and reverse positions shown in FIGS. 1 and 2. It is evident that displacement of the rotor for reverse drive will increase the distance between pivot rod 46 and nut 40, placing spring link 48 under tension and thus causing valve 44 to swing about its pivot until the valve reaches its closed position. Conversely, returning the rotor to its forward drive position will place link 48 under compression, causing the valve to swing back to its initial open position as required for the forward drive operation.

In forward drive, with apertures 42 closed and butterfly valve 44 in the fully open position, the rotating blades create a rearward propulsive water stream through the outer annular passageway in the shroud casing. At the same time a mixed flow of water and exhaust gases is induced from the gas exhaust chamber in housing 2 into and through the central passageway, and discharged into the ambient water downstream of the jet-pump. On shifting into reverse the reactive force moves the rotor rearward to the position of FIG. 2 wherein apertures 42 are open, butterfly valve 44 is fully closed, the propulsive stream flows forwardly through the outer annular passageway, and the exhaust gases are driven radially outward through apertures 42.

The parts associated with the variable-volume chamber 32 are designed with a close running fit, so that the dashpot functions as a shock absorber, thus controlling the axial sliding speed of the rotor during shifts between forward and reverse drive and preventing potentially harmful shock forces which could otherwise occur at the ends of the stroke. It is noted further that the flow-control device embodying the butterfly valve and its actuating mechanism is characterized by trouble-free simplicity of construction designed to assure minimum resistance to flow in the fully open position.

I claim:

1. Marine propulsion apparatus comprising a stator tube, a rotor having a rotor tube, said tubes being in axial alignment, and means mounting said rotor tube in axially displaceable relation with respect to said stator tube, said tubes having interengaging parts co-acting to form a variable-volume chamber for entrapping fluid and thereby controlling the axial rotor speed during displacement.

2. The structure recited in claim 1 and wherein said rotor is positioned forwardly of said stator tube and one of said interengaging parts has a recess in telescopic engagement with another of said parts.

3. The structure recited in claim 2 and wherein said recess is toroid-shaped, formed in said rotor tube, and coaxial with said tubes, and wherein said another interengaging part is the forward end of said stator tube.

4. Marine propulsion apparatus comprising a transmission housing, a stator tube, support means connecting said stator tube to said housing, a rotor having a rotor tube, said tubes being in alignment and forming an axial passageway, means mounting said rotor tube for axial displacement with respect to said stator tube between forward and rearward positions, said housing comprising an engine exhaust chamber communicating with a ring member fixed to said housing, said ring member being located between said housing and said rotor, said ring member being aligned with said tubes and telescopically engaging said rotor tube to form a substantially fluid-tight joint when said rotor is in the forward position, and to form an opening for the discharge of exhaust gases in radially outward directions at a location between said housing and said rotor when said rotor is in the rearward position, a butterfly valve mounted in said rotor tube for swinging about a transverse pivot axis between an open position and a closed position, said pivot axis being fixed with respect to said tube, and means responsive to axial displacement of said rotor for operating said valve, whereby said valve is open when said rotor is in the forward position and closed when said rotor is in the rearward position.

5. The structure recited in claim 4 and wherein said valve operating means includes a resilient link connected at one end to said valve and at its other end to means for maintaining said other end fixed against axial displacement with respect to said stator tube.

6. The structure recited in claim 5 and wherein said tubes have interengaging parts co-acting to form a variable-volume chamber for entrapping fluid and thereby controlling the axial speed of the rotor during its displacement relative to the stator.

7. The structure recited in claim 6 and wherein said rotor is positioned forwardly of said stator tube and one of said interengaging parts has a recess in telescopic engagement with another of said parts.

8. The structure recited in claim 7 and wherein said recess is toroid-shaped, formed in said rotor tube, and co-axial with said tubes, and wherein said another interengaging part is the forward end of said stator tube.

9. The structure recited in claim 3 and wherein said forward end constitutes a tubular plunger arranged for relative axial displacement within said recess, whereby the volume of said chamber is varied and said interengaging parts coact to function as a dashpot during relative axial movement of said parts.

10. The structure recited in claim 8 and wherein said forward end constitutes a tubular plunger arranged for relative axial displacement within said recess, whereby the volume of said chamber is varied and said interengaging parts coact to function as a dashpot during relative axial movement of said parts.

* * * * *